United States Patent [19]

Blaskowski

[11] 4,319,888

[45] Mar. 16, 1982

[54] APPARATUS FOR MIXING CHAR-ASH INTO COAL STREAM

[75] Inventor: Henry J. Blaskowski, Avon, Conn.

[73] Assignee: Combustion Engineering, Inc., Windsor, Conn.

[21] Appl. No.: 215,779

[22] Filed: Dec. 12, 1980

[51] Int. Cl.[3] ..... C10J 3/30

[52] U.S. Cl. ..... 48/77; 48/86 R; 48/210; 366/341

[58] Field of Search ..... 48/77, 86 R, 86 A, 210; 201/31; 366/341, 9

[56] References Cited

U.S. PATENT DOCUMENTS

| | | | |
|---|---|---|---|
| 2,750,330 | 6/1956 | Nelson | 201/31 X |
| 3,932,146 | 1/1976 | Wilson et al. | 48/210 |
| 4,163,693 | 8/1979 | Green | 201/31 X |
| 4,168,956 | 9/1979 | Blaskowski | 48/210 |

*Primary Examiner*—Richard V. Fisher
*Attorney, Agent, or Firm*—Robert L. Olson

[57] ABSTRACT

Apparatus for obtaining complete mixing of char with coal prior to the introduction of the mixture into the combustor (30) of a coal gasifier (10). The coal is carried in one air stream (22), and the char in another air stream (54), to a riffle plate arrangement (26), where the streams of solid are intimately mixed or blended.

2 Claims, 3 Drawing Figures

APPARATUS FOR MIXING CHAR-ASH INTO COAL STREAM

BACKGROUND OF THE INVENTION

One means of utilizing coal today is to generate combustible gas by the incomplete combustion of the coal in a coal gasifier. A typical gasifier is comprised of two zones. In the first, heat is generated for the gasification process. In this zone, coal is burned under stoichiometric (no excess air) conditions. The hot gas generated in the first zone is used to drive off the volatiles from coal introduced to the second zone. This zone is operated with little or no air introduced thereto, so little or no combustion of the coal takes place. The gas leaving the second zone is mainly carbon monoxide. This gas also carried with it a considerable amount of char, which is separated out of the gas stream after it leaves the gasifier. This char contains a considerable amount of combustible carbon and, thus, it can be recycled back to the first zone of the gasifier for complete combustion.

SUMMARY OF THE INVENTION

In accordance with the invention an entrained flow coal gasifier is provided which will operate efficiently to burn coal and recycled char to generate combustible gas. The recycled char is blended or mixed with the coal being introduced into the gasifier, so that they can be combusted in the same set of burners. The mixing of the coal and char is accomplished by means of a riffle plate arrangement.

DESCRIPTION OF THE PREFERRED EMBODIMENT

Figure 1:
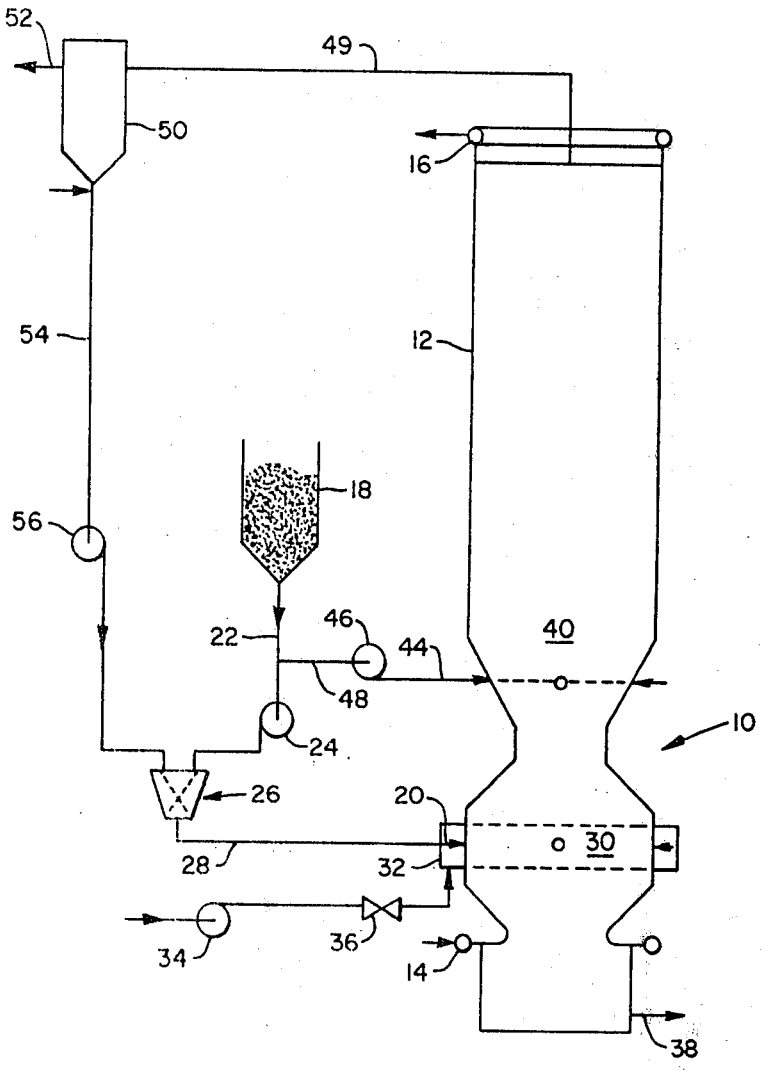
FIG. 1 is a schematic illustration of a coal gasifier.

Looking now to FIG. 1, numeral 10 designates a coal gasifier, the walls of which are lined with steam generating tubes 12. Water is applied to the lower header 14, with heated water or steam exiting from the upper header 16.

Coal from hopper 18 is supplied to a lower level of burners 20 through line 22, fan 24, riffle plate arrangement 26, and line 28. There are a plurality of burners 20 equally spaced around the periphery of the combustor 30, which burners are oriented for introducing the coal tangentially to the combustor. Wind box 32 similarly surrounds the combustor 30, and supplies air from fan 34 for supporting combustion of the combustibles introduced to the burners 20. The amount of air is controlled by damper 36 in such a manner that the fuel introduced to the burners 20 is burned stoichiometrically (with no excess air). Ash melts in the combustor 30 and is removed through slag spout 38. The combustion products pass upwardly into the reductor zone 40. Additional coal is introduced at this point through nozzle 44 by fan 46. This coal is heated by the hot gases coming from the combustor, causing the volatiles to be driven off. No air other than that introduced with the coal through lines 48 enters the reductor zone 40 and, hence, it is maintained under substoichiometric or reducing conditions. Accordingly, a low BTU gas is formed which exits from the gasifier 10 through line 49. The gas passes through a collector, such as a cyclone separator 50 with the gas passing on through line 52 for clean-up and its ultimate use. Fine particles of char are separated out in the collector 50 and returned through line 54, fan 56, riffle plate arrangement 26, and line 28 to the burner 20.

Figure 2:
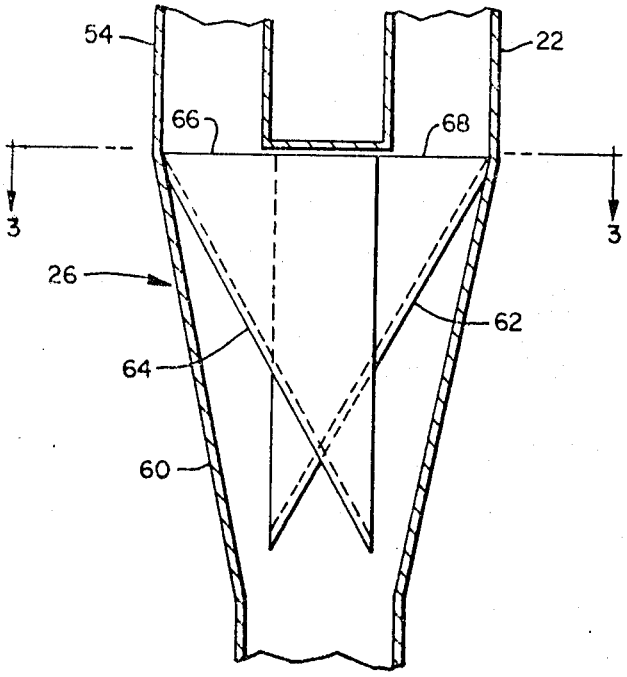
FIG. 2 is an enlarged sectional view of a riffle plate arrangement.
Figure 3:
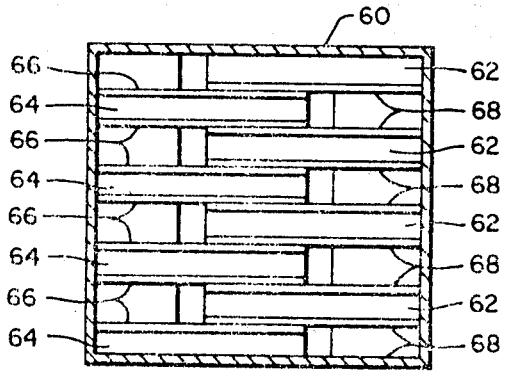
FIG. 3 is a view taken on lines 3—3 of FIG. 2.

For the most efficient and complete combustion of the char, it is important that the char particles be well mixed or blended with the coal particles when introduced into the burners 20. The riffle plate arrangement 26 accomplishes this. As shown in FIGS. 2 and 3, the char from line 54, and the coal from line 22, are introduced into the upper portion of the riffle plate housing 60. The riffle plate arrangement is made up of downwardly extending plates 62 and 64 projecting alternately from opposite sides of the housing 60, with their lower ends being inter-nested. Each of these plates or shutes 62 and 64 extend to a point past the center line of the housing 60, in an inter-nested relationship, and direct the air stream and solids to the opposite side of the housing. They also cause some turbulence in the flow, so that the solids are fairly well intermixed and blended.

Both sides of each plate 62 have a vertical plate 68 secured thereto, to help raise and support it. This also prevents solids from sliding off the sides of the plate. Likewise, each plate 64 has a pair of vertical plates 66 attached thereto for the same purpose. All of the plates 62 and 64 are secured to the housing 60 at their upper ends.

I claim:

1. Apparatus for generating low BTU gas from coal, including an entrained coal gasifier having means defining a first combustion zone, means defining a second reductor zone, a plurality of burners firing into the combustion zone, means for introducing combustibles, in the form of mixed coal and char, and oxygen to the combustion zone under substantially stoichiometric condition, means for introducing coal to the reductor zone under substoichiometric conditions, the reductor zone being located such that the hot gases from the combustion zone pass through the reductor zone, generating low BTU gas and char therein, means through which the low BTU gas and the char are discharged from the coal gasifier, means for separating the char from the low BTU gas, riffle plate means, the riffle plate means having an inlet end and an outlet end, the outlet end being connected to the burners, means for introducing char to one side of the inlet end, means for introducing coal to the other side of the inlet end, said riffle plate means including a plurality of first plates secured at the inlet end of the riffle plate means to said one side, and a plurality of second plates secured at the inlet end to said other side, the other ends of both said first and second plates extending inwardly and in a downstream direction to a point past the central axis of the riffle plate means, said first and second plates being of such number that they extend across and cover a major portion of the entire cross-section of the riffle plate means, the first and second plates running alternately with each other, so that their other ends are inter-nested, and thus, the first plates direct a portion of the char towards said other side of the riffle plate means, and the second plates direct a portion of the coal towards said one side of the riffle plate means, so that the coal and char flowing to the burners is thoroughly mixed or blended together.

2. The apparatus set forth in claim 1 wherein the first and second plates each have side members attached to and extending along both sides of each plate.

* * * * *